US006619576B2

(12) United States Patent
Togashi et al.

(10) Patent No.: US 6,619,576 B2
(45) Date of Patent: Sep. 16, 2003

(54) OUTLET CLEARANCE ADJUSTMENT MECHANISM OF JAW CRUSHER AND SELF-PROPELLED CRUSHING MACHINE LOADED WITH JAW CRUSHER HAVING OUTLET CLEARANCE ADJUSTMENT MECHANISM OF JAW CRUSHER

(75) Inventors: Ryoichi Togashi, Kawasaki (JP); Motoki Kurohara, Hirakata (JP); Mitsunobu Yamada, Iruma (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/951,520

(22) Filed: Sep. 14, 2001

(65) Prior Publication Data

US 2002/0036246 A1 Mar. 28, 2002

(30) Foreign Application Priority Data

Sep. 26, 2000 (JP) ..... 2000-292089

(51) Int. Cl.[7] ..... B02C 1/06
(52) U.S. Cl. ..... 241/101.74; 241/268
(58) Field of Search ..... 241/264–269, 241/101.74

(56) References Cited

U.S. PATENT DOCUMENTS 3,150,571 A 9/1964 Frassetto et al.

FOREIGN PATENT DOCUMENTS

| | | |
|---|---|---|
| JP | 63-141638 | 9/1988 |
| JP | 63-141639 | 9/1988 |
| WO | WO97/36683 | 10/1997 |

*Primary Examiner*—Mark Rosenbaum
(74) *Attorney, Agent, or Firm*—Armstrong, Westerman & Hattori, LLP

(57) ABSTRACT

An outlet clearance adjustment mechanism of a jaw crusher, which is small in size, simple in structure, and capable of reducing outlet clearance adjusting time, is provided. For this purpose, the outlet clearance adjustment mechanism includes a toggle block (30) having a downward inclined plane (31), a toggle block frame (32) having a mounting surface (33) on which the toggle block (30) is slidably mounted and an inclined plane (34) provided to oppose the downward inclined plane (31), a detachable clearance adjustment shim (36) provided between the opposing downward inclined plane (31) and the inclined plane (34), and the hydraulic type of mechanical lock cylinder (40) provided at a back side of the inclined plane (34) of the toggle block frame (32).

2 Claims, 13 Drawing Sheets

OUTLET CLEARANCE ADJUSTMENT MECHANISM OF JAW CRUSHER AND SELF-PROPELLED CRUSHING MACHINE LOADED WITH JAW CRUSHER HAVING OUTLET CLEARANCE ADJUSTMENT MECHANISM OF JAW CRUSHER

TECHNICAL FIELD

The present invention relates to an outlet clearance adjustment mechanism for adjusting an outlet clearance between a stationary jaw and a movable jaw of a jaw crusher, and a self-propelled crushing machine loaded with a jaw crusher having the outlet clearance adjustment mechanism.

BACKGROUND ART

An example of a jaw crusher will be explained with reference to a self-propelled jaw crusher 1 shown in FIG. 7. In FIG. 7, a traveling body 2 is loaded with a hopper 3, a feeder 4, a jaw crusher 10, and a belt conveyor 5. The jaw crusher 10 includes a stationary jaw 11 and a movable jaw 12 swingingly moves relative thereto, which form a V shape with a wide upper portion. A material 6 to be crushed such as a concrete block, rock, stone or the like is charged into the hopper 3, transferred to an upper portion of the jaw crusher 10 by the feeder 10, then crushed inside the jaw crusher 10, and discharged outside from a lower outlet by the belt conveyor 5 to be a product. The grain diameter of a crushed product is determined by an outlet clearance δ between the stationary jaw 11 and the movable jaw 12. When the stationary jaw 11 and the movable jaw 12 are worn as a result of continuing crushing for a long time, or the grain diameter of the crushed product is to be changed, it is necessary to accurately readjust the outlet clearance δ. Thus, jaw crushers generally include outlet clearance adjustment mechanisms.

Various kinds of outlet clearance adjustment mechanisms of jaw crushers are conventionally proposed, and those disclosed in, for example, Japanese Utility Model Laid-open No. 63-141638, Japanese Utility Model Laid-open No. 63-141639, and International Application Laid-open No. WO97/36683 are well known.

FIG. 8 is a side view of what is disclosed in Japanese Utility Model Laid-open No. 63-141638 as the first example. At a guide 60 provided at a frame 7, to which the stationary jaw 11 of the jaw crusher 10 is mounted, at a back side of the movable jaw 12, a toggle block 61 is disposed slidably toward the movable jaw 12. A tip end portion of a toggle plate 13 abuts a first abutment portion 14 provided at a lower portion of the back of the movable jaw 12. A base end portion of the toggle plate 13 abuts a second abutment portion 15 provided at a front portion of the toggle block 61. An oil hydraulic cylinder 64 including a hydraulic mechanical lock device 62 at a piston rod 63 side is fixedly provided at the frame 7 at a back side of the toggle block 61. A tip end portion of the piston rod 63 abuts the back of the toggle block 61 via a roller 65. A pre-tension device 20 for always biasing the lower portion of the movable jaw 12 toward the toggle block 61 and holding the toggle plate 13 between the first abutment portion 14 and the second abutment portion 15 is provided between the movable jaw 12 and the frame 7. The pre-tension device 20 is constituted by a spring 23 held between a bracket 21 fixed to the frame 7 and a washer 24, and a rod 22 connected to a lower end portion of the moving jaw 12 at one end and penetrating through the spring 23 and the washer 24 and fastened by a nut 25 at the other end. The movable jaw 12 is supported at the frame 7 via an eccentric shaft 16 at an upper end portion, so that rotation of the eccentric shaft 16 swings the movable jaw 12.

During an operation of the jaw crusher 10, the hydraulic mechanical lock device 62 is locked. When the outlet clearance between the stationary jaw 11 and the movable jaw 12 is to be adjusted, a worker operates a hydraulic device (not shown) to release the lock of the hydraulic mechanical lock device 62. Thereafter, the outlet clearance is adjusted by extending or contracting the hydraulic cylinder 64, and then the hydraulic mechanical lock device 62 is locked again.

FIG. 9 is a side view of what is disclosed in Japanese Utility Model Laid-open No. 63-141639 as the second example. The explanation of the same components as the first example is omitted by giving the identical numerals and symbols, and only the different parts will be explained. An oil hydraulic cylinder 72 including a hydraulic mechanical lock device 71 is horizontally attached at a back side of a U-shaped bracket 70 fixedly provided at the frame 7 at the back side of the movable jaw 12, and the oil hydraulic cylinder 72 is connected to a rear end portion of a toggle block 73. An adjustment plate 74 is inserted between the bracket 70 and the toggle block 73. An upper oil hydraulic cylinder 76 including the hydraulic mechanical lock device 71 is attached upright at a bracket 75 fixedly provided at the frame 7 above the toggle block 73. The upper oil hydraulic cylinder 76 is connected to the toggle block 73 to pull it upward and fix it. The upper oil hydraulic cylinder 76 is movable in a substantially horizontal direction toward the movable jaw 12, and is attachably and detachably fastened to the bracket 75 by a bolt 77.

During an operation of the jaw crusher 10, the toggle block 73, the adjustment plate 74, and the bracket 70 are in close contact with each other, and the hydraulic mechanical lock devices 71 and 71 are locked. When the outlet clearance is to be adjusted, a worker operates a hydraulic device (not shown) to release the lock of the hydraulic mechanical lock devices 71 of the oil hydraulic cylinder 72 and the upper oil hydraulic cylinder 76. Next, the bolt 77 of the upper oil hydraulic cylinder 76 is loosened to extend the upper oil hydraulic cylinder 76 a little. Subsequently, the oil hydraulic cylinder 72 is extended or contracted to adjust the thickness of the adjustment plate 74 to thereby adjust the outlet clearance, and the oil hydraulic cylinder 72 is contracted to bring the adjustment plate 74 in close contact. Next, the upper hydraulic cylinder 76 is contracted, then the bolt 77 is fastened, and the respective oil hydraulic mechanical lock devices 71 and 71 are locked.

FIG. 10 is a side view of the outlet clearance adjustment apparatus disclosed in International Application Laid-open WO97/36683 as the third example, and FIG. 11 is a view seen from the arrows 11—11 in FIG. 10. The same components as the first example are given the identical numerals and symbols, the explanation thereof will be omitted, and only the different parts will be explained. In FIG. 10 and FIG. 11, a downward inclined plane 31 with a lower portion being protruded is formed on a surface of the toggle block 30 opposite to the toggle plate 13. A mounting surface 33 for mounting a toggle block 30 thereon slidably toward the movable jaw 12 is provided on a toggle block frame 32 fixedly provided at the frame 7. Further, an inclined plane 34 matching the aforementioned downward inclined plane 31 of the toggle block 30 is provided on a surface of the toggle block frame 32 opposing the toggle block 30 to form a V-shaped opening portion 35 with the mounting surface 33. A clearance adjustment shim 36 is inserted between the downward inclined plane 31 of the toggle block 30 and the inclined plane 34 of the toggle block frame 32. A pair of oil hydraulic cylinders 80 and 80 are attached at the toggle block frame 32, and piston rods 81 and the toggle block 30 at the side of the downward inclined place 31 are connected by connecting pins 82. The pre-tension device 20 is provided between the movable jaw 12 and the toggle block frame 32.

FIG. 12 is an oil hydraulic circuit diagram of the clearance adjustment apparatus of the third example. An output circuit of an oil hydraulic source 83, and a head side circuit 85 and a bottom side circuit 88 of the oil hydraulic cylinder 80 are connected via an electromagnetic change-over valve 84. The electromagnetic change-over valve 84 has three positions f, g, and h. The oil hydraulic cylinder 80 is contracted at the position f, the oil hydraulic cylinder 80 is held at the position g, and the oil hydraulic cylinder 80 is extended at the position h. An accumulator 86 and a pressure switch 87 are connected to the head side circuit 85 of the oil hydraulic cylinder 80. An operation lever 57, the electromagnetic change-over valve 84, and a pressure switch 87 are connected via a controller 58.

Next, an operation will be explained based on FIG. 10 and FIG. 12. During a crushing operation, the electromagnetic valve 84 is at the position g, and the head side circuit 85 and the bottom side circuit 88 of the oil hydraulic cylinder 80 are closed. When the outlet clearance is to be adjusted, a worker operates the operation lever 57 to switch the electromagnetic change-over valve 84 to the position h by a command signal from the controller 58 to thereby extend the oil hydraulic cylinder 80. Next, the clearance adjustment shim 36 is adjusted to determine the position of the toggle block 30 to thereby set the outlet clearance. Subsequently, the operation lever 57 is operated to switch the electromagnetic change-over valve 84 to the position f to thereby contract the oil hydraulic cylinder 80, whereby the toggle block 30, the clearance adjustment shim 36 and the toggle block frame 32 are in close contact with each other.

FIG. 13 is a plane view of the conventional outlet clearance adjustment mechanism being the fourth example. Since the relationship between the toggle block frame 32 and the toggle block 30 is the same as that of the third example, the explanation with a side view will be omitted and only the different parts will be explained. In FIG. 13, the same components as in the third example are given the same numerals and symbols. An oil hydraulic cylinder 90 attached to a center portion of the toggle block frame 32 are connected to the toggle block 30. A pair of tension rods 91 and 91 for connecting the toggle block 30 and the toggle block frame 32 are provided at the left and right side of the oil hydraulic cylinder 90. Double nuts 92 and 92 are fastened to rear end portions of the tension rods 91 and 91, whereby the toggle block 30 is brought into close contact with the toggle block frame 32.

The oil hydraulic cylinder 90 is in a floating state during a crushing operation, with the double nuts 92 being fastened. When the outlet clearance is to be adjusted, the double nuts 92 and 92 are loosened to extend the oil hydraulic cylinder 90, and the thickness of the clearance adjustment shim 36 is adjusted to determine the position of the toggle block 30. Next, the oil hydraulic cylinder 90 is contracted to bring the toggle block 30, the clearance adjustment shim 36 and the toggle block frame 32 into close contact with each other to be in a floating state, and thereafter the double nuts,92 and 92 are fastened.

However, in the aforementioned conventional structures, the following disadvantages exist.

(a) In the first example, all the large thrust forces applied to the toggle plate 13 during a crushing operation is applied to the hydraulic mechanical lock device 62 and the oil hydraulic cylinder 64. Consequently, the hydraulic mechanical lock device 62 and the oil hydraulic cylinder 64 with large capacity are required, thus increasing the apparatus in size, whereby the cost becomes high.

(b) In the second example, the upper oil hydraulic cylinder 76 in the vertical direction is required, and it is necessary to loosen the bolt 77 and extend the upper oil hydraulic cylinder 76 every time the outlet clearance is adjusted and it is necessary to contract the upper oil hydraulic cylinder 76 again and fasten the bolts 77 after the adjustment is finished, thus requiring a long time for adjustment. In addition, the number of components are large, and the cost is high with the complicated structure.

(c) In the third example, as shown in the side view in FIG. 10 and the oil hydraulic circuit diagram in FIG. 12, when a clearance exists in the clearance adjustment shim 36, all the thrust forces applied to the toggle block 30 is applied to the bottom side of the oil hydraulic cylinder 80. Consequently, if a mistake is made in operating the operation lever 57 at the time of the clearance adjustment and a clearance exists in the portion into which the clearance adjustment shim 36 is inserted, there is the fear that a bottom side pipeline 88 of the oil hydraulic cylinder 80 is broken when a large thrust force is applied to the toggle block 30.

(d) In the fourth example, the tension rods 91 and 91, and the double nuts 92 and 92 are provided for fixing the position of the toggle block 30. As a result, each time when the clearance is adjusted, the operation of loosening the double nuts 92 and 92 and fastening them again after the adjustment is required, thus requiring a long working time. The working time reaches, for example, thirty minutes or more.

SUMMARY OF THE INVENTION

The present invention is made in view of the aforementioned disadvantages, and its object is to provide an outlet clearance adjustment mechanism of a jaw crusher, which is compact, simple in structure, without the fear of breakage, and capable of reduce outlet clearance adjusting time, and a self-propelled crushing machine loaded with a jaw crusher having the outlet clearance adjustment mechanism.

In order to attain the aforementioned object, an outlet clearance adjustment apparatus of a jaw crusher according to the present invention includes a stationary jaw mounted to a frame, a movable jaw which faces the stationary jaw and swingingly moves, a toggle block placed at a back of the movable jaw and abutting the movable jaw via a toggle block plate, and a toggle block frame fixedly provided at the frame and supporting the toggle block, and has a constitution in that the toggle block has a downward inclined plane with a lower portion being protruded on a face at an opposite side to the toggle plate, the toggle block frame has a mounting surface on which the toggle block having the downward inclined plane is slidably mounted, and an inclined plane provided to oppose the downward inclined plane, and the outlet clearance adjustment mechanism includes a detachable clearance adjustment shim provided between the downward inclined plane and the inclined plane opposing each other, and a hydraulic type of mechanical lock cylinder provided at a back side of the inclined plane of the toggle block frame, and adjusts an outlet clearance between the stationary jaw and the movable jaw.

According to the above constitution, the downward inclined plane is provided on the toggle block to be fitted onto the inclined plane of the frame, and therefore when thrust force is applied to the toggle block, downward force occurs to the toggle block. Thus, a vertical hydraulic cylinder is not necessary, thus making the structure simple. Further, since the inclined plane of the frame receives thrust force, the capacity of the hydraulic type of mechanical lock cylinder may be small, thus making it possible to reduce the apparatus in size. Even if the clearance adjustment shim portion has a clearance at the time of adjustment, the hydraulic type of mechanical lock cylinder slides to cause the inclined plane to abut it, and thus there is no fear of breakage. Further, since the outlet clearance adjustment can be performed only by extending and contracting the hydraulic type of mechanical lock cylinder, the operation is simple and adjusting time is short, which is efficient.

Further, a self-propelled crushing machine loaded with a jaw crusher having the outlet clearance adjustment mechanism of the jaw crusher according to the present invention has a constitution in which a jaw crusher having the outlet clearance adjustment mechanism of the jaw crusher of the aforementioned constitution is mounted on a self-propelled vehicle.

According to the above constitution, the jaw crusher having the outlet clearance adjustment mechanism of the present invention is movable, whereby the operation can be performed in the sites where it is required, thus enhancing efficiency.

BEST MODE FOR CARRYING OUT THE INVENTION

A preferred embodiment of an outlet clearance adjustment mechanism of a jaw crusher and a self-propelled crushing machine loaded with a jaw crusher having the outlet clearance adjustment mechanism according to the present invention will be explained in detail below with reference to the drawings.

Figure 1:
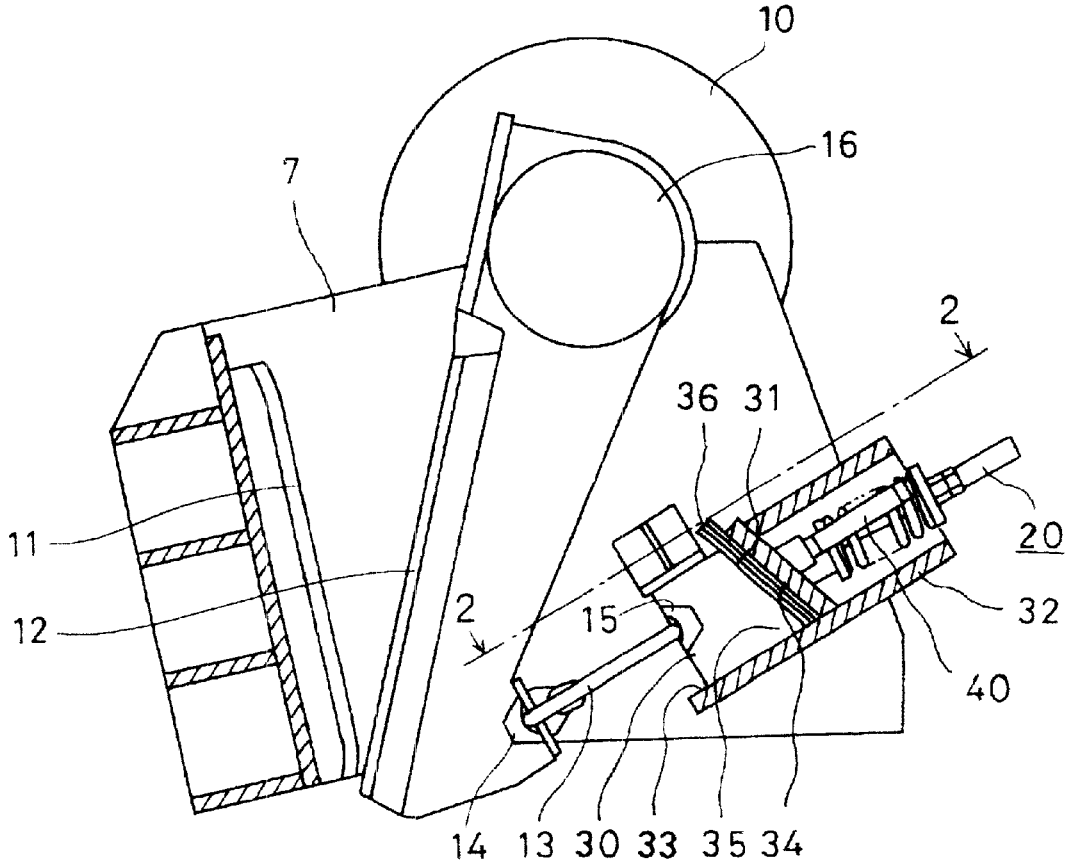
FIG. 1 is a partially sectional side view of an outlet clearance adjustment mechanism of the present invention.
Figure 2:
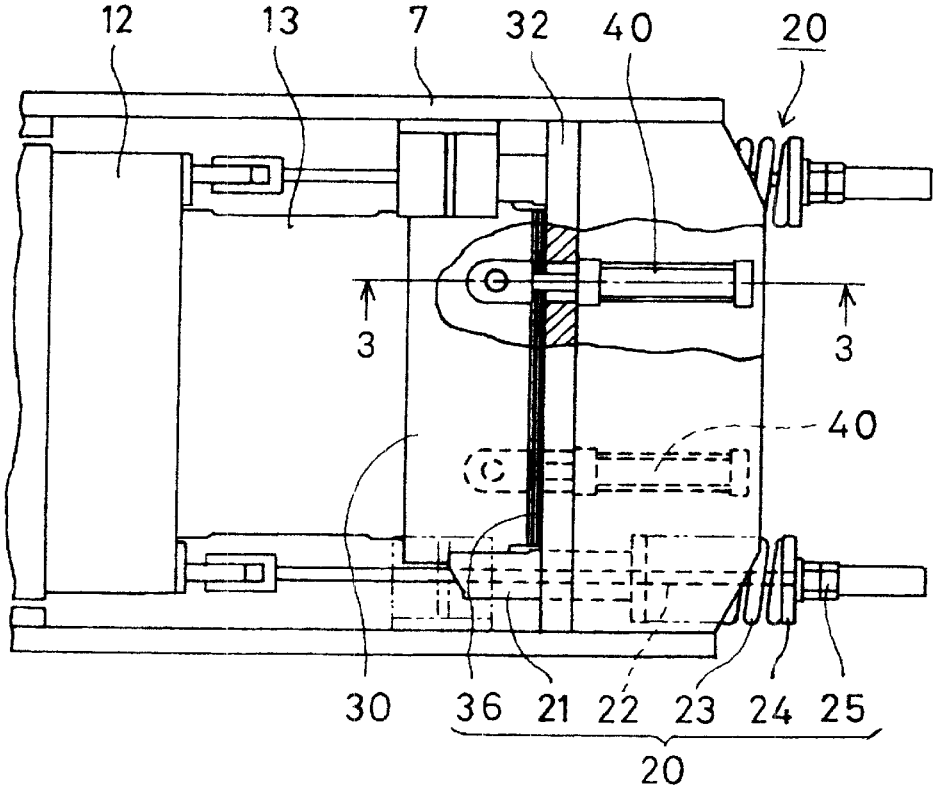
FIG. 2 is a view seen from the arrows 2—2 in FIG. 1.

FIG. 1 is a side view showing an example of the outlet clearance adjustment mechanism of the present invention, and FIG. 2 is a view seen from the arrows 2—2 in FIG. 1. In FIG. 1 and FIG. 2, a stationary jaw 11 is mounted to a frame 7 of a jaw crusher 10, and a movable jaw 12 is swingably attached to face it by an eccentric shaft 16. A toggle block frame 32 is fixedly provided at the frame 7 at a back side of the movable jaw 12 to slidably support a toggle block 30. A tip end portion of a toggle plate 13 abuts a first abutment portion 14 provided at a lower end portion of a back of the movable jaw 12, and a rear end portion of the toggle plate 13 abuts a second abutment portion 15 provided at a front of the toggle block 30. A downward inclined plane 31 with a lower portion being protruded is formed on a rear face of the toggle block 30. The toggle block frame 32 forms a V-shaped opening 35 by a mounting surface 33 for mounting the toggle block 30 thereon slidably toward the back of the movable jaw 12, and an inclined plane 34 matching the downward inclined plane 31 of the toggle block 30, which is provided on a surface facing the toggle block 30. A clearance adjustment shim 36 is inserted between the downward inclined plane 31 and the inclined plane 34. A pair of hydraulic type of mechanical lock cylinders 40 and 40 are attached at a back side of the inclined plane 34 of the toggle block frame 32. Pre-tension devices 20 and 20 for biasing a lower end portion of the movable jaw 12 toward the toggle block 30 all the time are provided at both sides of the hydraulic type of mechanical lock cylinders 40 and 40.

Figure 3:
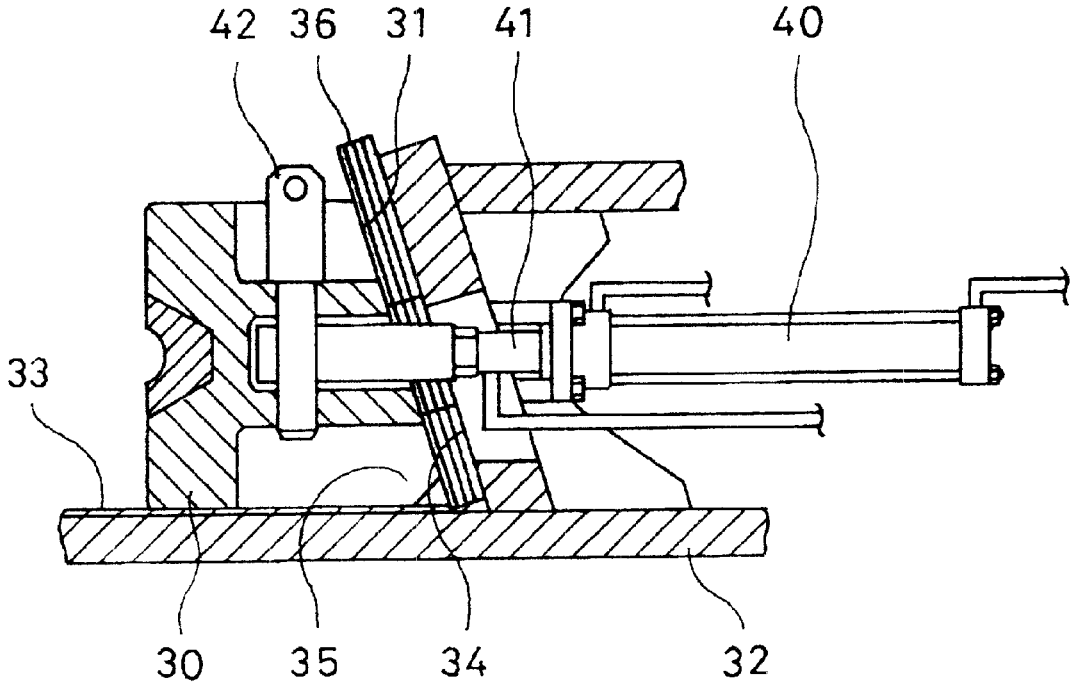
FIG. 3 is a view seen from the arrows 3—3 in FIG. 2.

As shown in FIG. 2, the pre-tension device 20 includes a spring 23 abutting a bracket 21 fixedly provided at the toggle block 30, a washer 24 abutting a rear end portion of the spring 23, a rod 22 connected to a lower portion of the movable jaw 12 at one end and penetrating through the aforementioned spring 23 and the washer 24 at the other end, and a nut 25 for fastening the rod 22 to the washer 24. As shown in FIG. 3 being a view seen from the arrows 3—3 in FIG. 2, a piston rod 41 of the hydraulic type of mechanical lock cylinder 40 is connected to the toggle block 30 by a connecting pin 42.

Figure 4:
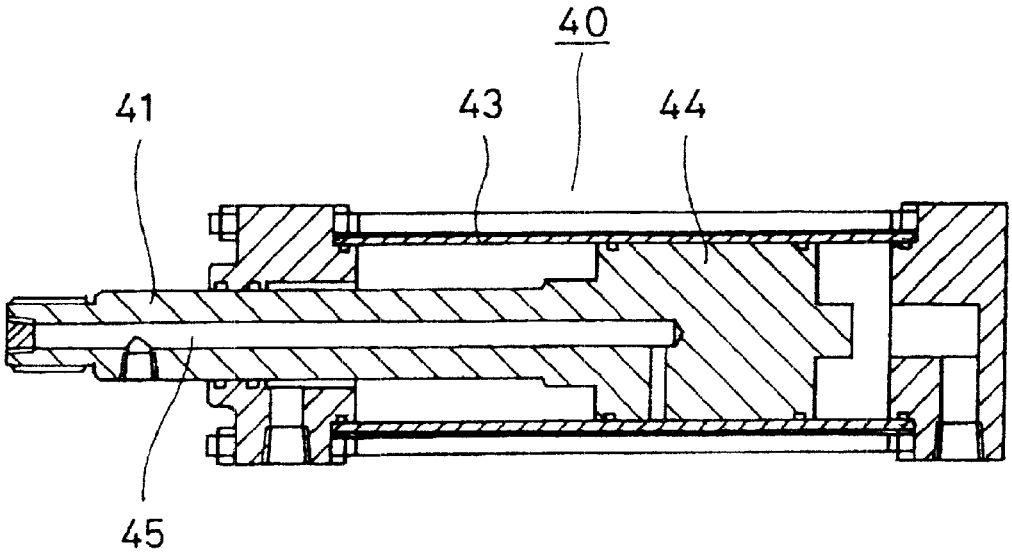
FIG. 4 is a sectional side view of a hydraulic type of mechanical lock cylinder according to the present invention.
Figure 5:
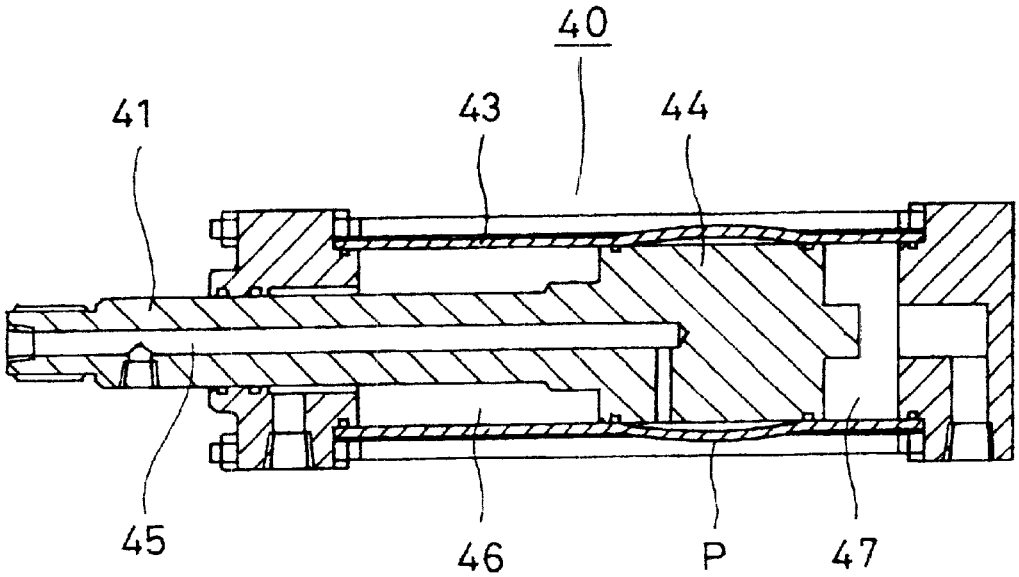
FIG. 5 is an explanatory view of an operation of the hydraulic type of mechanical lock cylinder according to the present invention.

FIG. 4 is a sectional view of the hydraulic type of mechanical lock cylinder 40. A piston 44 having the piston rod 41 is press-fitted in the cylinder 43. The piston rod 41 is provided with an oil hole 45, which is communicated with an outside surface of the piston 44. FIG. 4 shows a state in which pressure oil is not supplied into the oil hole 45 from the outside, and in this state, the piston 44 is fixed in the position with frictional resistance between the piston 44 and the cylinder 43. When the hydraulic type of mechanical lock cylinder 40 is to be extended and contracted, the pressure oil is supplied into the oil hole 45 to expand the cylinder 43 on the outer surface portion of the piston 44 as a portion P to thereby expand the inner diameter as shown in FIG. 5. This expansion reduces the frictional resistance between the piston 44 and the cylinder 43 to reduce the press fit force of the piston 44, whereby pressure oil is supplied into a cylinder head chamber 46 or a cylinder bottom chamber 47 to allow the piston 44 to move.

Figure 6:
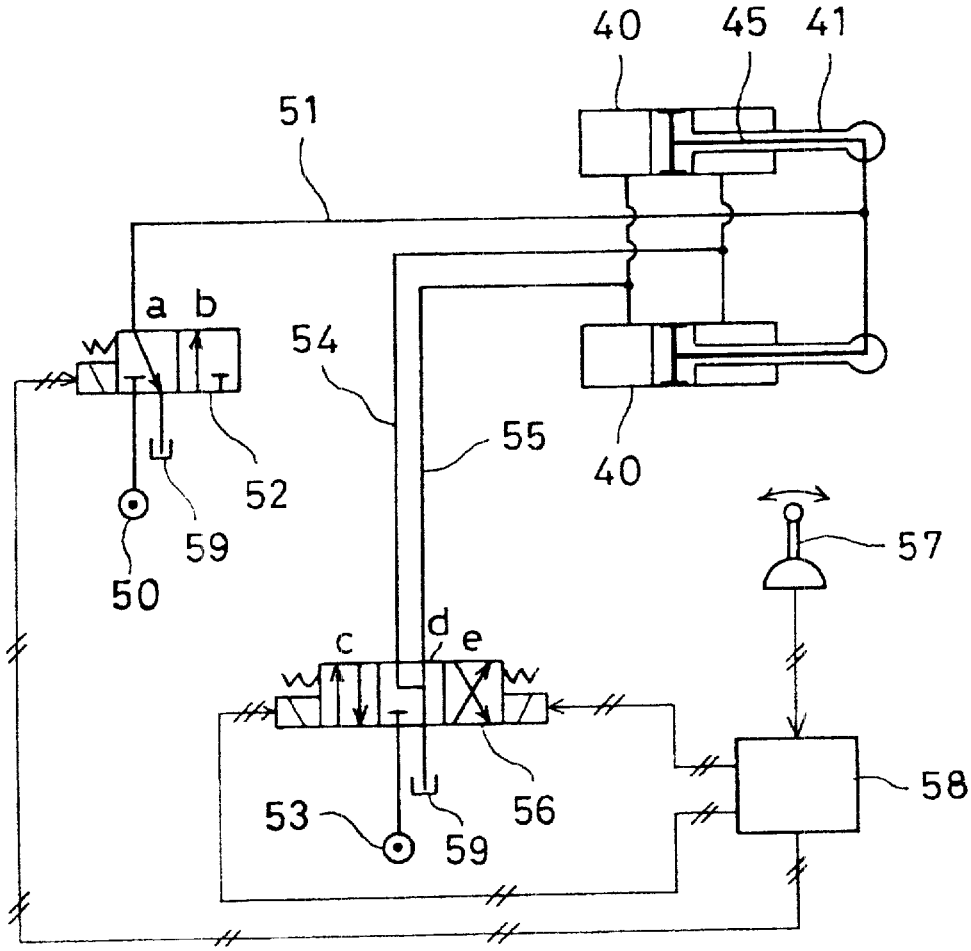
FIG. 6 is a hydraulic circuit diagram of the outlet clearance adjustment mechanism of the present invention.

FIG. 6 is an oil hydraulic circuit diagram of the outlet clearance adjustment mechanism of the present invention. In FIG. 6, a first electromagnetic change-over valve 52 is provided on a piston circuit 51 connecting the oil hole 45 of the piston rod 41 of the hydraulic type of mechanical lock cylinder 40 and a first oil pressure source 50. A second electromagnetic change-over valve 56 is provided on a head circuit 54 and a bottom circuit 55 for connecting the hydraulic type of mechanical lock cylinder 40 and a second oil pressure source 53. The first electromagnetic change-over valve 52 has two positions a and b. In the position a, the piston circuit 51 is connected to a tank 59, and in the position b, it is connected to a discharge circuit of the first oil pressure source 50. The second electromagnetic valve 56 has three positions c, d and e. In the position c, the head circuit 54 is connected to the second oil pressure source 53, in the position d, the head circuit 54 and the bottom circuit 55 are connected to the tank 59, and in the position e, the bottom circuit 55 is connected to the second oil pressure source 50. An operation lever 57 connects to the first electromagnetic change-over valve 52 and the second electromagnetic change-over valve 56 via a controller 58.

Next, an operation will be explained. During a crushing operation, the downward inclined plane 31 abuts the inclined plane 34 of the toggle block frame 32 via the clearance adjustment shim 36. The hydraulic type of mechanical lock cylinder 40 is in a state in which it is locked. Accordingly, the toggle block frame 32 receives large thrust force from the movable jaw 12, and rattling in a longitudinal direction of the toggle block 30 is prevented by the hydraulic type of mechanical lock cylinder 40. When the outlet clearance is to be adjusted, the operation lever 57 is operated to output a control signal to the first electromagnetic change-over valve 52 from the controller 58 to switch the first electromagnetic change-over valve 52 to the position b, whereby pressure oil is supplied to the piston 44 of the hydraulic type of mechanical lock cylinder 40 via the piston circuit 51 to expand the cylinder 43. Next, the operation lever 57 is operated to output the control signal to the second electromagnetic valve 56 from the controller 58 to switch it to the position e, whereby the pressure oil is supplied to the bottom circuit 55 to extend the hydraulic type of mechanical lock cylinder 40. Subsequently, the thickness of the clearance adjustment shim 36 is adjusted to thereby adjust the outlet clearance. Next, the operation lever 57 is operated to switch the second electromagnetic change-over valve 56 to the position c, whereby the pressure oil is supplied to the head circuit 54 to contract the hydraulic type of mechanical lock cylinder 40 to thereby bring the toggle block 30, the clearance adjustment shim 36, and the inclined plane 34 of the toggle block frame 32 in close contact with each other. Next, the first electromagnetic change-over valve 52 is switched to the position a, whereby the clearance adjustment operation is finished.

The clearance adjustment operation is simple as described above, and the operating time is only about three minutes by a person, which is sharp reduction in the operating time as compared with the aforementioned 30 minutes cited as an example of the prior arts. Since the head circuit 54 and the bottom circuit 55 of the hydraulic type of mechanical lock cylinder 40 are connected to a drain circuit during the crushing operation, abnormal oil pressure does not occur to the head circuit 54 and the bottom circuit 55, thus eliminating the fear of breakage. Further, the hydraulic type of mechanical lock cylinder 40 is used only for preventing the toggle block 30 from rattling and for moving the toggle block 30 on the occasion of outlet clearance adjustment, and therefore a small-sized cylinder is sufficient, thus making it possible to reduce the size and cost of the apparatus.

Figure 7:
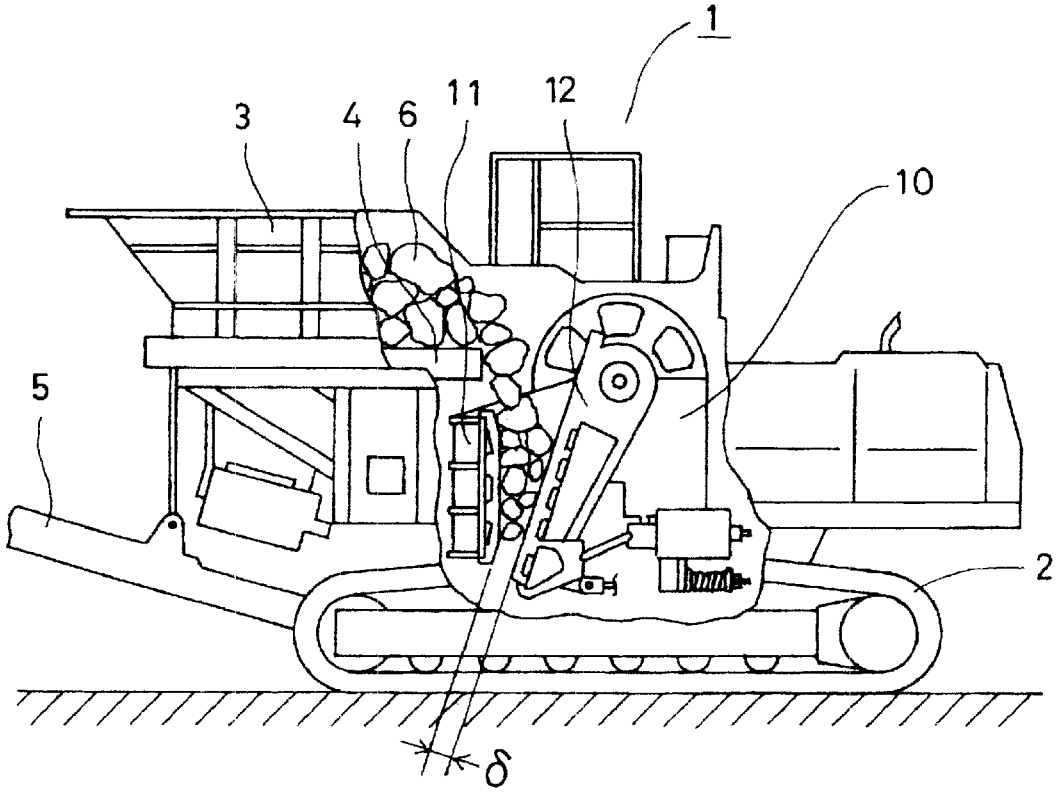
F I G. 7 PRIOR ART
FIG. 7 is a partially sectional side view of a conventional self-propelled jaw crusher.
Figure 8:
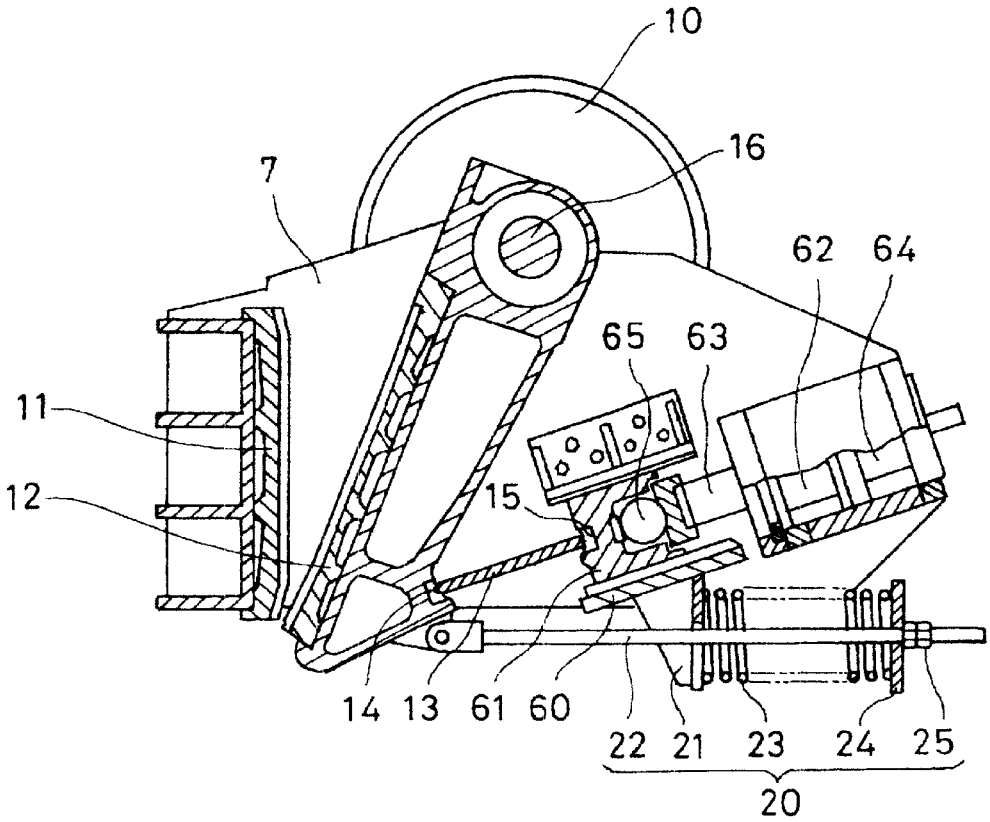
F I G. 8 PRIOR ART
FIG. 8 is a sectional side view of a conventional outlet clearance adjustment mechanism being a first example.
Figure 9:
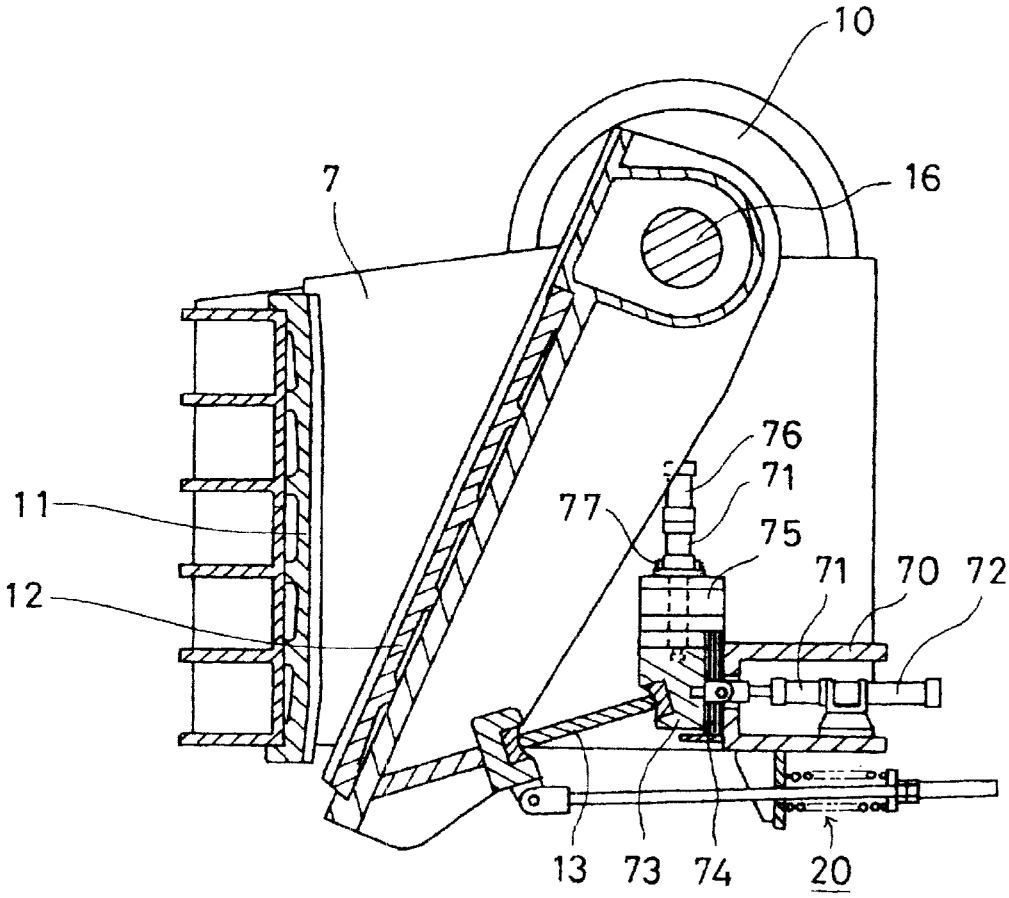
F I G. 9 PRIOR ART
FIG. 9 is a sectional side view of a conventional outlet clearance adjustment mechanism being a second example.
Figure 10:
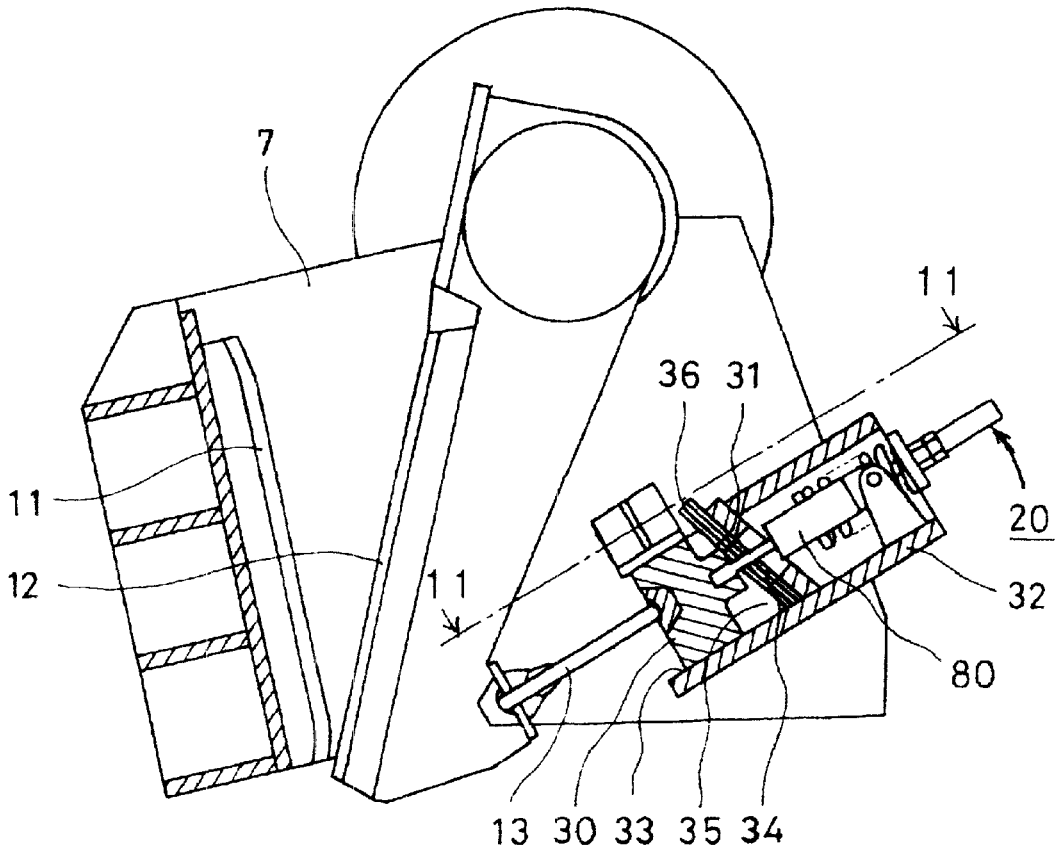
FIG. 10 PRIOR ART
FIG. 10 is a sectional side view of a conventional outlet clearance adjustment mechanism being a third example.
Figure 11:
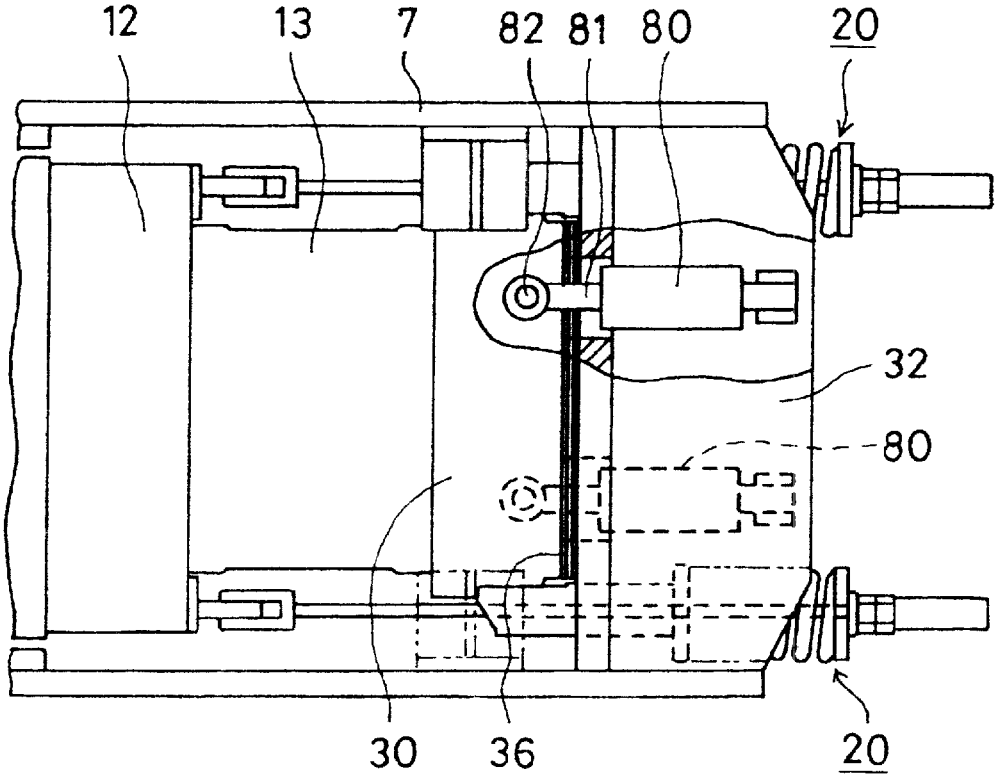
F I G. 1 1 PRIOR ART
FIG. 11 is a view seen from the arrows 11—11 in FIG. 10.
Figure 12:
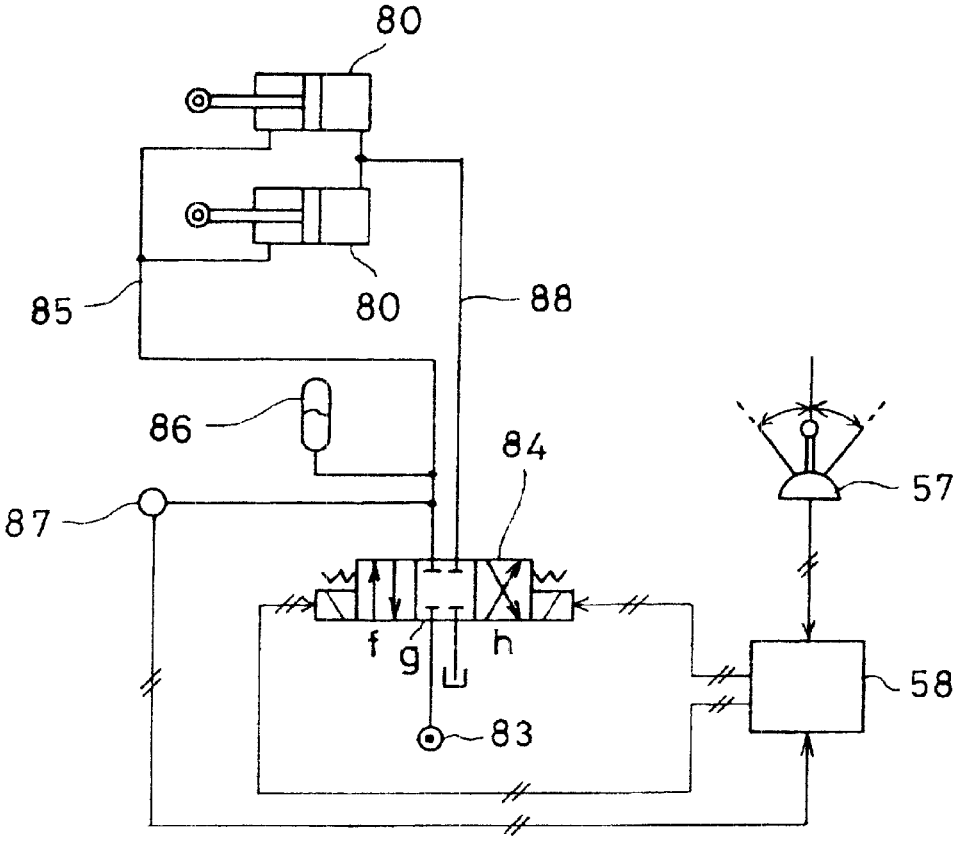
F I G. 1 2 PRIOR ART
FIG. 12 is a hydraulic circuit diagram of the conventional outlet clearance adjustment mechanism being the third example.
Figure 13:
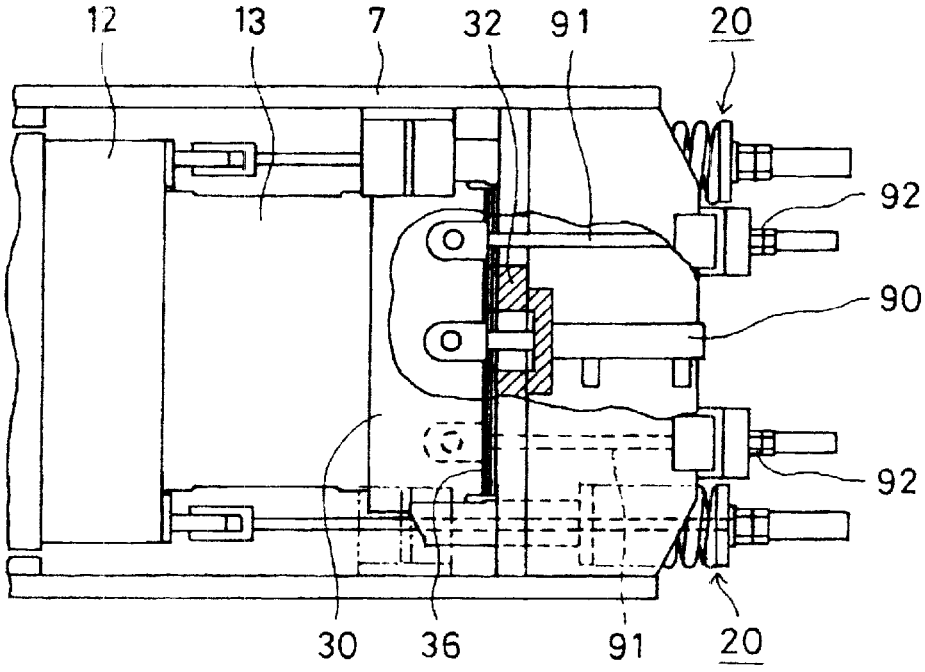
FIG. 13 PRIOR ART
FIG. 13 is a plane view of a conventional outlet clearance adjustment mechanism being a fourth example.

In the above, the embodiment of the outlet clearance adjustment mechanism of the jaw crusher is explained, and it is useful to mount a jaw crusher having the outlet clearance adjustment mechanism of the embodiment according to the above described present invention and use it as the self-propelled crushing machine. Here, as the self-propelled vehicle, any ordinary self-propelled vehicle may be suitable. As a result of the above, it becomes movable, whereby operation in the sites where it is required becomes possible, thus enhancing efficiency. As a concrete example of the self-propelled crushing machine, it may be suitable to mount the jaw crusher 10 having the outlet clearance adjustment mechanism of the above-described embodiment according to the present invention in place of the conventional jaw crusher 10 in the self-propelled jaw crusher 1 shown in FIG. 7.

What is claimed is:

1. An outlet clearance adjustment mechanism of a jaw crusher, said jaw crusher including a stationary jaw mounted to a frame;

a movable jaw which faces said stationary jaw and swingingly moves;

a toggle block placed at a back side of said movable jaw and abutting said movable jaw via a toggle plate; and a toggle block frame fixedly provided at said frame and supporting said toggle block;

wherein said toggle block has a downward inclined plane with a lower portion being protruded on a surface at an opposite side to said toggle plate, and wherein said toggle block frame has a mounting surface on which the toggle block having said downward inclined plane is slidably mounted, and an inclined plane provided to oppose said downward inclined plane;

said outlet clearance adjustment mechanism comprising:

a detachable clearance adjustment shim provided between said downward inclined plane and said inclined plane opposing each other; and a hydraulic mechanical lock cylinder provided at a back side of the inclined plane of said toggle block frame;

wherein said outlet clearance adjustment mechanism adjusts an outlet clearance between said stationary jaw and said movable jaw.

2. A self-propelled crushing machine, comprising a self-propelled vehicle loaded with a jaw crusher including an outlet clearance adjustment mechanism of the jaw crusher, said jaw crusher including:

a stationary jaw mounted to a frame;

a movable jaw which faces said stationary jaw and swingingly moves;

a toggle block placed at a back side of said movable jaw and abutting said movable jaw via a toggle plate; and a toggle block frame fixedly provided at said frame and supporting said toggle block;

wherein said toggle block has a downward inclined plane with a lower portion being protruded on a surface at an opposite side to said toggle plate, and wherein said toggle block frame has a mounting surface on which the toggle block having said downward inclined plane is slidably mounted, and an inclined plane provided to oppose said downward inclined plane;

said outlet clearance adjustment mechanism comprising:

a detachable clearance adjustment shim provided between said downward inclined plane and said inclined plane opposing each other; and a hydraulic mechanical lock cylinder provided at a back side of the inclined plane of said toggle block frame;

wherein said outlet clearance adjustment mechanism adjusts an outlet clearance between said stationary jaw and said movable jaw.

* * * * *